US007168355B2

(12) United States Patent
Bascom et al.

(10) Patent No.: US 7,168,355 B2
(45) Date of Patent: Jan. 30, 2007

(54) FIBER CHOPPER AND METHOD OF CHOPPING

(75) Inventors: Randall Clark Bascom, Wauseon, OH (US); Douglas James Kempski, Holland, OH (US); John Joseph Dembowski, Athens, TN (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 10/215,243

(22) Filed: Aug. 8, 2002

(65) Prior Publication Data

US 2004/0025653 A1 Feb. 12, 2004

(51) Int. Cl.
*B26D 5/08* (2006.01)

(52) U.S. Cl. ..... 83/552; 83/563; 83/564; 83/913; 83/345

(58) Field of Classification Search ..... 83/913, 83/950, 552, 563, 564, 345–347
See application file for complete search history.

(56) References Cited

U.S. PATENT DOCUMENTS

| | | | | | |
|---|---|---|---|---|---|
| 3,704,765 | A | * | 12/1972 | Withrow et al. | 188/134 |
| 3,815,461 | A | * | 6/1974 | Genson | 83/347 |
| 4,014,227 | A | * | 3/1977 | Adams | 82/173 |
| 4,576,621 | A | * | 3/1986 | Chappelear et al. | 65/536 |
| 4,637,286 | A | * | 1/1987 | Boggs | 83/175 |
| 5,118,082 | A | * | 6/1992 | Byun | 254/102 |
| 5,195,415 | A | * | 3/1993 | Buck et al. | 83/176 |
| 5,970,837 | A | * | 10/1999 | Arterburn et al. | 83/552 |

* cited by examiner

*Primary Examiner*—Boyer D. Ashley
*Assistant Examiner*—Omar Flores Sánchez
(74) *Attorney, Agent, or Firm*—Robert D. Touslee

(57) ABSTRACT

A method and apparatus for chopping long unwound items like fiber, fiber strands, yarn, etc. The chopper has a backup roll, a blade roll and a biasing system for forcing the backup roll and the blade roll together at a desired force during set up and operation. The biasing system contains a mechanism such as a slip clutch or a limited torque stepping motor for maintaining a substantially constant biasing force at set up and during operation while allowing the rolls to separate slightly to pass a temporary thicker feed without recoil that currently shortens blade and backup roll working layer life.

2 Claims, 7 Drawing Sheets

FIBER CHOPPER AND METHOD OF CHOPPING

BACKGROUND

The present invention involves an improved chopper for chopping continuous or very long loose items such as fiber, fiber strands, yarn, wire, string, ribbon, tape and the like by pulling the item(s) into the chopper while the loose items are held tightly against the surface of a rotating backup roll with a rotating idler roll biased against the backup roll and carrying the item(s) on into a nip between a rotating blade roll and the rotating backup roll where they are separated into short pieces. More specifically the present invention involves a chopper having an improved mechanism for biasing the backup roll and the blade roll against each other during the chopping operation.

It has long been known to chop continuous fibers or fiber strands into short lengths of about 3 inches or shorter. Billions of pounds of such product including chopped glass fibers and fiber strands are produced each year in process and chopping apparatus such as disclosed in U.S. Pat. Nos. 5,970,837, 4,398,934, 3,508,461, and 3,869,268, the disclosures of which are incorporated herein by reference. The choppers disclosed in these patents comprise a blade roll containing a plurality of spaced apart blades for separating the fibers into short lengths, a backup roll, often or preferably driven, which the blades work against to effect the separation and which pulls the fibers or fiber strands and an idler roll to hold the fibers or fiber strands down onto the surface of the backup roll. In the chopped fiber processes disclosed in these patents, the chopper is usually the most productivity limiting equipment in the processes. These processes typically operate continuously every day of the year, 24 hours each day, except during furnace rebuilds every few years. Therefore, improvements in the chopper, which allow the chopper to pull and chop faster and for longer times between maintenance shutdowns, and/or to pull and chop more fibers or fiber strands at a time, have an extremely positive impact on productivity and production costs.

In the prior art, the backup roll has been mounted and held against the surface of the blade roll in a generally rigid manner such as with a mechanical screw jack and a gear head stepping motor or with a variable force such as a force applied by an air or hydraulic cylinder. A shear pin or equivalent has also been used as a safety feature in the event a thicker stream of fiber strands comes to the chopper, but when the shear pin fails, considerable down time is incurred and production is lost while the shear pin is replaced and the chopper is put back on line.

The mechanical jack was set up by manually running the gear motor to bias one of the backup roll or blade roll into the other roll until the blades had penetrated the working layer of the backup roll an appropriate amount. If the blades did not penetrate far enough, double cuts or stringers, long strands, would result, an unacceptable result. If the blades penetrated too far, the chopper would chop the strands properly, but the backup roll life would be shortened substantially. Given these options, at least some operators tended to run the jacuator too long in setting up a rebuilt chopper, or if a chopping problem developed, thus reducing backup roll life substantially below what it could be if the choppers are set up properly. This is a costly situation causing this system to be abandoned in favor of using fluid cylinders with or without shear pins.

Normally several strands such as up to 14 are fed into the chopper, each strand containing 2000 or more fibers. As more fiber strands and fibers are fed into the chopper it becomes more difficult to pull all of the strands and fibers at the same speed, so more pressure is applied to the cylinder pushing the idler roll against the backup roll with more force.

Occasionally a glass bead from a fiberizing bushing or a wad of fibers will be pulled to the chopper caught up in the multitude of fiber strands. When this happens, it is necessary for one of the backup roll or blade roll to be able to move away from the other roll to allow this thicker anomaly to pass through the nip between the blade roll and the backup roll. If this separation does not occur the chopper will often lock up causing damage to the drives, belts and/or the rolls.

Although at least one of the rolls is held in position with a fluid cylinder, the fluid is either not compressible or responds too slowly to the sudden problem to protect the chopper from damage and downtime. In the past the shear pin was used to provide such protection. However, when the shear pin shears the blade roll and backup roll are no longer biased together properly requiring that the chopper be shut down to install a new shear pin. This downtime is costly because of the loss of production during the downtime and due to reduced material efficiency for several minutes following restart. Downtime causes forehearth and bushing temperature upsets because hanging fibers do not pull in cooling air that occurs when the chopper is pulling the fibers from the bushings.

If all of the strands or fibers are not pulled at the same speed, the slower strands and fibers will have a greater fiber diameter which is unacceptable and the bushings of the slower strands frequently will not operate at the proper temperature causing more frequent breakouts and/or additional fiber diameter variations, both of which are unacceptable. Also, fiber slippage can cause some of the fibers to be cut to shorter lengths than desired resulting in an unacceptable product. Therefore, it is very important that the biasing force between the blade roll and the backup roll remain proper and essentially constant.

As the pulling speed is increased, and/or as the number of strands and fibers are increased, above about 3000–4000 ft./min. (FPM), depending on the product, the present state of the art choppers begin to vibrate and the idler roll begins to allow one or more of the strands to slip some thus reducing the pulling speed of one or more of the strands. Also, if all of the strands are not pressed between the idler roll and the elastomer layer of the backup roll, a strand can slip partially out of the nip leaving some of the fibers unchopped, producing double cuts and stringers in the chopped product and causing the product to be scrapped.

U.S. Pat. No. 3,731,575 teaches an air cylinder with an adjustable stop to bias the blade roll against the backup roll so that the blades penetrate the backup roll the desired distance and no further. However, with this arrangement, the pressure in the cylinder increases when a wad or bead or other thicker strand set passes through the chopper and forces the backup roll to back away from the blade roll. Also, an air cylinder bias is subject to permitting vibration at high speeds and is therefore not desirable. Finally, this system suffers the same problem as the mechanical jack system in that it requires an operator to set the mechanical stop limiting the distance the blades can penetrate the working layer of the backup roll.

It would be very desirable for the chopper to have an adjustable, but constant biasing force between the backup roll and the blade roll while having the ability to instantaneously respond to a substantially thicker feed of material to be chopped without requiring any downtime or without causing unnecessary scrap.

SUMMARY OF THE INVENTION

The present invention is an improved chopper for separating long lengths of one or more unwound items selected from a group consisting of fibers, fiber strands, wires, strings, tape(s), strip(s) and ribbon(s) into short lengths. One or more of, preferably a plurality of, the long lengths of material are pulled into the chopper in an unwound form at speeds exceeding 1,000 FPM, preferably at speeds exceeding 2000 FPM, by the peripheral surface of an elastomer layer on the peripheral surface of a rotating backup roll which carries the item(s) on into a nip between the elastomer layer and a rotating blade roll. The improvement is a biasing assembly that biases, presses, the blade roll and the backup roll together with an adjustable, but substantially constant force. The biasing system comprises a mechanism that will instantaneously allow a slightly thicker portion of the items to pass through the nip of the blade roll and backup roll while allowing the chopper to resume normal chopping quickly without shutting down and without rebounding such that the blades penetrate excessively into the working layer of the backup roll. The item(s) being chopped can be either dry or wet with or without a chemical sizing on the surface of the item(s). Preferably, the mechanism is an adjustable slip clutch.

The improvement to the chopper comprises an assembly for biasing either the blade roll against the backup roll, the backup roll against the blade roll or both rolls together, the biasing assembly comprising a mechanical jack, a drive for driving the mechanical jack to bias or force one of either of the blade roll or backup roll against the other roll and, in some embodiments, the drive preferably being a stepping motor having a torque that closely matches the desired force on the jack that will drive the blades the desired amount into the backup roll. Some preferred embodiments can use a gear motor in conjunction with a slipping mechanism.

Another preferred embodiment is similar to that embodiment just described, but the drive is a stepping motor having higher torque. Its method of use is different comprising setting up a program for the stepping motor that advances the stepping motor a specific number of steps according to the diameter of the backup roll on the chopper, which changes as the backup roll is reconditioned. The operator inputs the diameter and the stepping motor automatically advances enough to move the blades of the blade roll into the working surface of the backup roll the desired amount each time and holds them there. This embodiment can optionally use a slipping mechanism located between the stepping motor and the mechanical jack.

In some embodiments the biasing assembly also includes a slipping mechanism located between the mechanical jack and the drive. In these embodiments the assembly for biasing comprises a slipping mechanism connected between the drive and the mechanical jack that having a desired torque limit that is either fixed or adjustable and that will slip to limit the amount of force exerted by the mechanical jack and that will also could allow the mechanical jack to retract instantaneously to relieve excessive pressure in the nip between the backup roll and the blades or blade roll.

The invention also includes a method of chopping items as described above using the improved chopper described above having a novel biasing mechanism to bias the blade roll and the backup roll together as described above for separating the items into short lengths while optimizing backup roll working layer and blade lives.

When the word "about" is used herein it is meant that the amount or condition it modifies can vary some beyond that so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without unexpected characteristics, those embodiments are within the meaning of the term about as used herein. It is not difficult for the skilled artisan or others to determine whether such an embodiment is either as might be expected or, because of either a break in the continuity of results or one or more features that are significantly better than reported by the inventor, is surprising and thus an unobvious teaching leading to a further advance in the art.

DETAILED DESCRIPTION OF THE INVENTION

Figure 1:
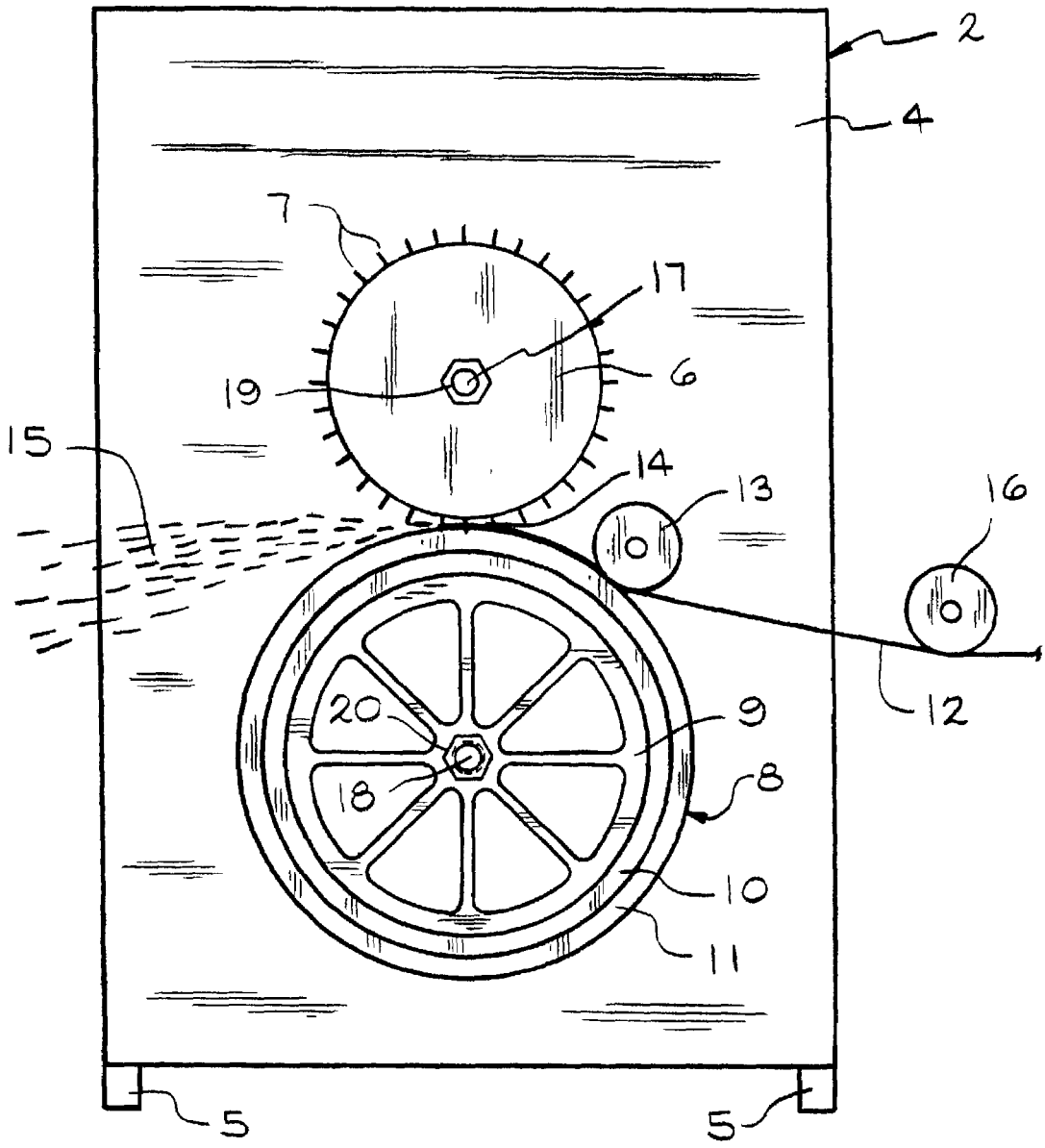
FIG. 1 PRIOR ART
FIG. 1 is an elevational view of a chopper of the present invention with a portion cut away to show the novel biasing assembly.

FIG. 1 shows a front elevation view of a typical prior art chopper 2 used in making chopped strand glass fiber. It comprises a frame and front plate 4, feet 5, a blade roll 6 with spaced apart blades 7 contained in slots and projecting from the periphery of a blade holder integrated into the blade roll 6, a backup roll 8 and an idler roll 13. The blade roll 6 is mounted on a rotatable spindle 17 and held in place with a large nut 19. The blade roll 6 is usually made of metal and thermoplastic material such as the blade rolls shown in U.S. Pat. Nos. 4,083,279, 4,249,441 and 4,287,799, the disclosures of which are herein incorporated by reference.

The backup roll 8 is comprised of a hub and spoke assembly 9 with an integral metal rim 10 on which is cast or mounted a working layer 11 of an elastomer or thermoplastic material such as polyurethane. The backup roll 8 is mounted on a second spindle 18 and held in place with a large nut 20. To operate the spindle 18 of the backup roll 8 is moved towards the spindle 17 of the blade roll 6 until the blades 7 of the blade roll 6 press into the working layer 11 of the backup roll 8 a proper amount forming a nip 14 to break or separate fiber strands 12 into an array of short lengths.

One or more, usually eight or more and up to 20 or more strands 12, such as glass fiber strands, each strand containing 400–6000 or more fibers and usually having water and/or an aqueous chemical sizing on their surfaces, are pulled by the backup roll 8, in cooperation with a knurled idler roll 13, into the chopper 2 and the nip 14. The strands 12 first run under a grooved oscillating, separator and guide roll 16, preferably with one or two strands in each groove, and upward and over the outer surface of the backup roll 8. The working surface of the back up roll 8 is typically wider than the oscillating path of the glass fiber strands 12. The strands 12 then pass under the outer knurled surface of the idler roll 13, which is pressed against the strands at a desired pressure to enable pulling of the glass fiber strands. The strands remain on the surface of the working layer 11 and next pass into the nip 14 between the backup roll 8 and the blade roll 6 where they are separated with the razor sharp blades 7 wherein the strands are usually cleanly cut or broken into an array of chopped strand 15 having the desired length.

The improved chopper 2 of the present invention and illustrated in FIGS. 2–5 comprises a novel biasing system such as a preferred biasing assembly 24. The backup roll spindle 18, in turn holding the backup roll 8 in a rotatable manner, is supported with multiple bearings in a known manner on a pivoting beam 20 that is held in a pivoting manner with a pin 22. As the pivoting beam 20 is raised, the outer working surface of the backup roll 8 is pressed against the blades 7. The biasing assembly 24 is attached to the pivoting beam 20 in a manner that will be described later and a mechanical jack 26 is manipulated to bias the backup roll 8 against the blades 7 of the blade roll 6 in the manner shown in FIG. 2.

Figure 3:
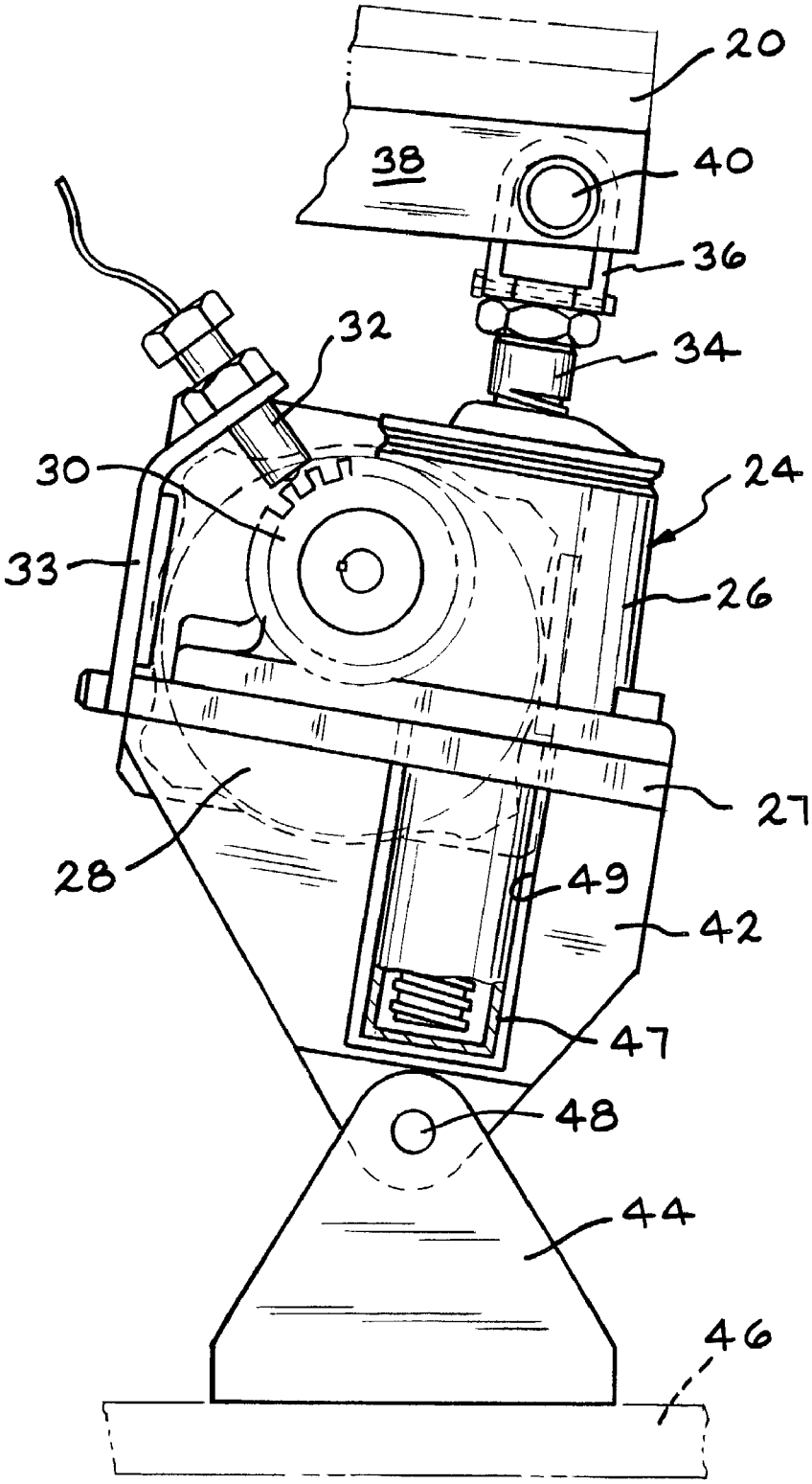
FIG. 3 is a blown up elevational view of the preferred embodiment of the novel biasing system of the present invention.
Figure 4:
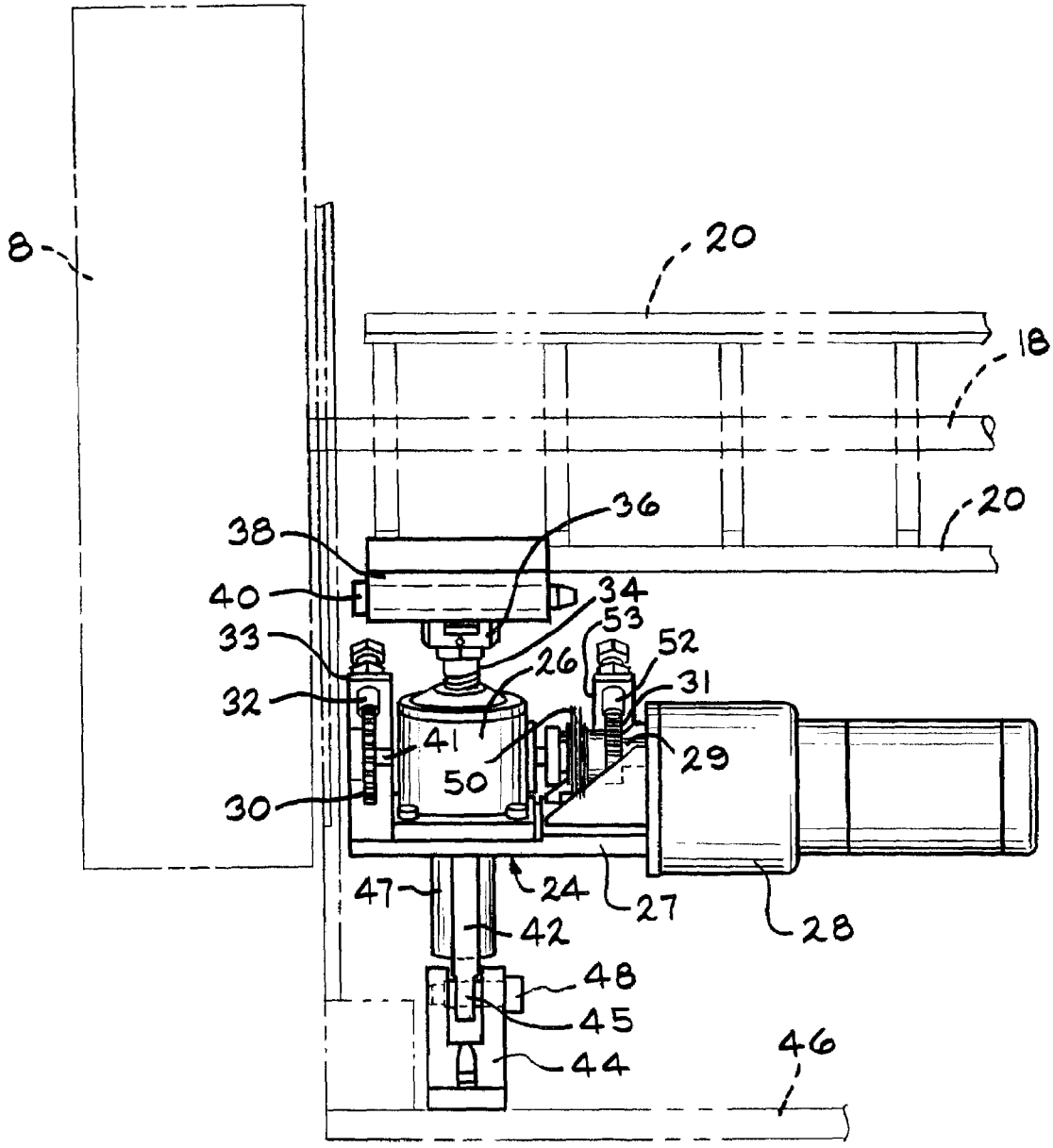
FIG. 4 is a partial side view of one preferred embodiment of the invention shown in FIG. 2.
Figure 5:
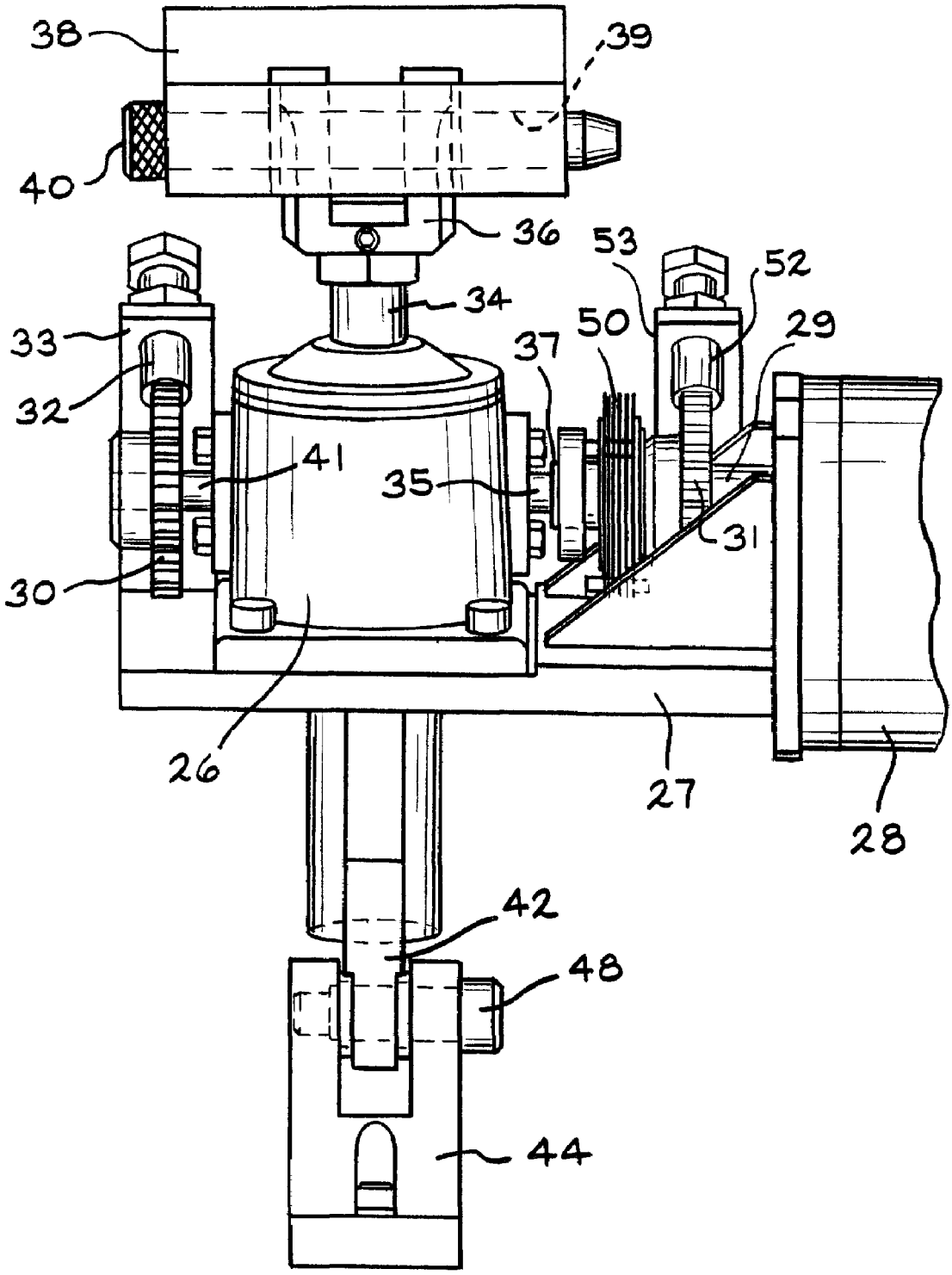
FIG. 5 is a blown up side view of the novel biasing system of the present invention shown in FIG. 4.

FIGS. 3–5 show one preferred embodiment of the biasing assembly of the present invention in more detail. The preferred biasing assembly 24 is comprised of a mechanical jack 26, such as an Acme screw jack called a Jactuator™, having a rotatable input shaft 35 for extending or retracting a rod 34 of the screw jack, a rotating means such as a conventional stepping motor, conventional motor and gear reducer or gearhead motor combination 28 having an output shaft 29, conventional controls for the gear motor (not shown), a slipping mechanism, such as a slip clutch 50, for connecting the gear motor 28 to the rotatable shaft 35, the slipping mechanism 50 providing an adjustable, constant torque to the rotatable shaft 35 of the mechanical jack 26, and means for securing one end of the screw jack 26 to the frame of the chopper and the other end to the pivoting beam 20. When a stepping motor is used as the motor 28, a conventional programmed control can be used allowing the operator to key in the number of steps for the stepping motor to advance or backoff. All motors used are reversable motors.

This preferred biasing system 24 also comprises a toothed gear 30 attached to a rotatable output shaft 41 of the mechanical jack 26, a tooth sensor and counter 32 for counting the number of passing teeth of the toothed gear 30, a bracket 33 for holding the tooth sensor and counter 32 in the proper location, and a mounting plate 27 for mounting the mechanical jack 26, the gear motor 28 and the bracket 33.

Figure 2:
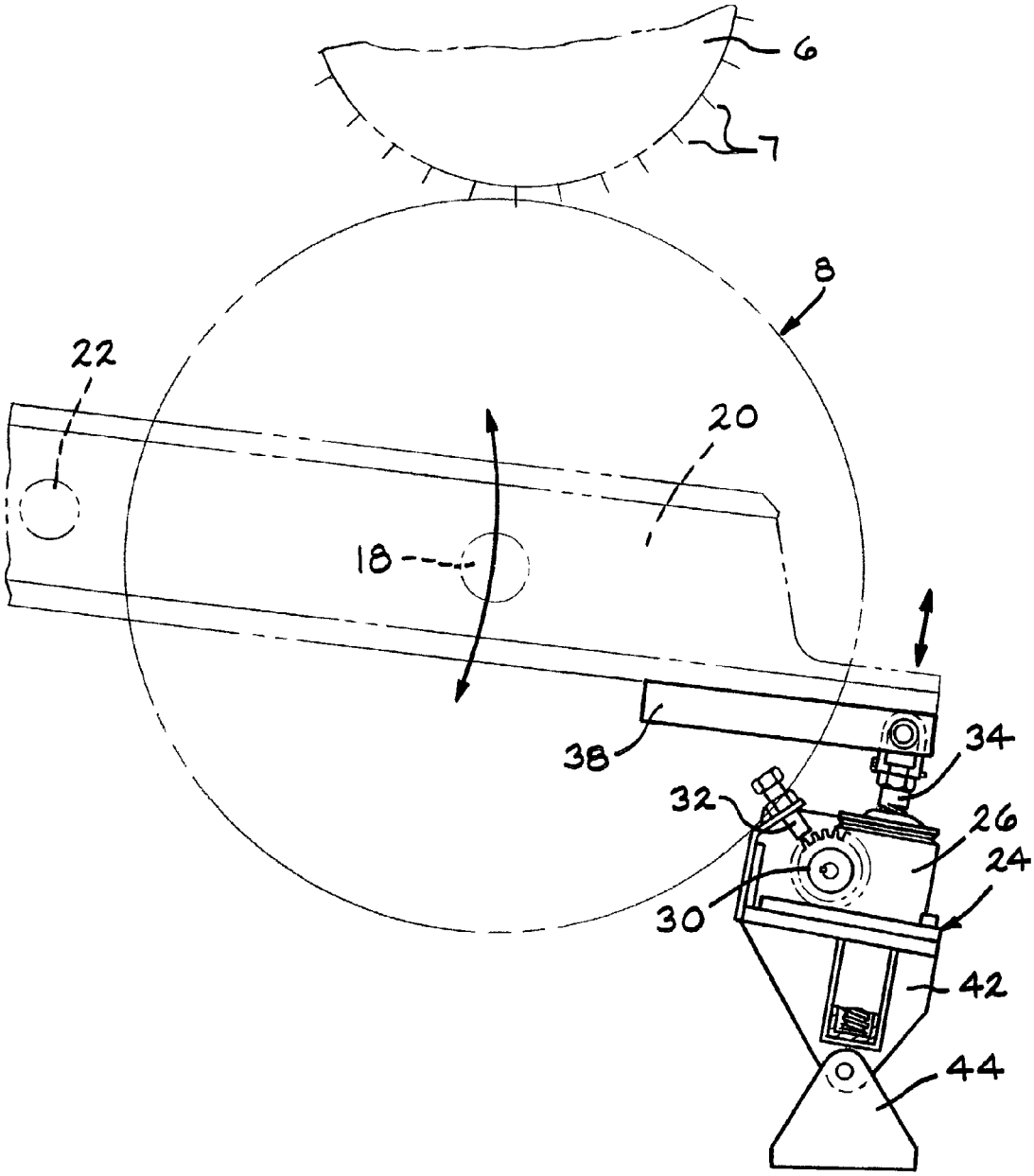
FIG. 2 is a partial elevational view of the interior of the chopper shown in FIG. 1 showing the support for the backup roll and backup roll spindle and showing a preferred embodiment of the novel biasing system of the present invention.

The means for securing mechanical extenuating means or screw jack 26 to the pivoting beam 20 preferably comprises a clevis mount 38 having a hole 39 therethrough and an opening for a clevis attached in any known suitable manner to the underneath surface of the outer end of the pivoting beam 20 as shown in FIG. 2. A clevis 36 is rotatably attached to the end of the mechanical jack rod 34 in a known manner. The clevis 36 is then pivotly attached to the clevis mount 38 with a pin 40 in a known manner.

The means for attaching the mechanical jack means, screw jack 26 and jackscrew-housing 47 for the jackscrew that is the lower portion of shaft 34 is a plate 42 having on one end an integral eye 42. The other end of the plate 42 is attached to the underneath side of the mounting plate 27, preferably centered under the body of the screw jack 26, in any suitable manner, such as with threaded metal bolts whose heads are recessed in the top portion of the mounting plate 27. The plate 42 has a cutout portion 49 so the plate 42 can straddle the jackscrew housing 47 as shown in FIG. 3. This preferred means for securing the mechanical jack 26 to the frame of the chopper comprises pivotly attaching the eye 45 of plate 42 to a mounting bracket 44 with a bolt 48 having a threaded end that threads into a threaded opening of the mounting bracket 44 as shown in FIG. 5. The mounting bracket 44 can be attached in any known manner, such as by welding, to a lower frame member 46 of the chopper.

As the gear motor 28 is energized and rotates its output shaft, coupled to the input side of the slipping mechanism, such as the input side of the slip clutch 50, with any suitable known coupling device, rotates the slip clutch 50 turning an output shaft of the slip clutch 50 unless the external load exceeds the torque limit of the slip clutch 50. The output side 37 of the slip clutch 50 is coupled to the input shaft 35 of the mechanical screw jack 26 with any suitable coupling device. The slip clutch 50 can one that is adjustable or, if one is concerned with the proper setting being changed for the wrong reason, a slip clutch with a fixed, non-adjustable torque limit, can be used, selecting the proper slip clutch 50 for the desired torque limit.

To operate the preferred chopper biasing system described above, the operator first either selects a slip clutch 50 having a torque limit that will press the backup roll 8 against the blades 7 with desired amount of force or, if the slip clutch 50 has an adjustable torque limit, sets the torque limit to achieve the same objective. A preferred torque limit for the type of chopper shown in FIG. 1 is one that will allow the screw jack 26 to exert about 1000 pounds force. Then the operator starts the stepping motor with gear head 28 in a direction that will cause the screw jack 26 to raise the jackshaft 34 thus raising the pivoting beam 20. The screw jack 26 will continue to raise the backup roll 8 into the blades 7 until the resistance of the blades penetrating the elastomer layer of the backup roll 8 reaches level where the torque on the input shaft 35 of the screw jack 26 reaches the torque limit of the slip clutch 50.

At that time the gear motor can be reversed to back off the screw jack 26 about 10 teeth on the toothed gear 30 as counted by the tooth counter 32 followed by shutting off the gear motor, but it is preferred that the slip clutch 50 slips continuously during operation to maintain the desired bias or force pressing the backup roll 8 into the blades 7 at all times during resting or during operation until the stepping motor is stopped or reversed. The stepping motor is usually stopped when the chopper is shut down and reversed to back the backup roll 8 away from the blades 7 when it is desired to remove the blade roll 6 and/or the backup roll 8.

This preferred biasing system 24 can also comprise a second toothed gear 31 attached to the gear/stepping motor output shaft 29, a second tooth sensor/counter 52 for counting the number of passing teeth of the toothed gear 31, a second bracket 53, attached to the mounting plate 27, for holding the second tooth sensor/counter 52 in the appropriate location. With the optional second tooth sensor/counter 52, the operator can quickly determine when the slip clutch 50 is slipping because said second sensor/counter 52 will be showing that the second toothed gear 31 is turning while the first toothed gear 30 is either turning slower or not at all. This tells the operator when to stop trying to advance the gear/stepping motor 28 to bias the blade roll 6 and the backup roll 8 together.

During operation, if a wad of fibers, bead or other oversize feed comes to the nip between the backup roll 8 and the blades 7, the high torque transmitted to the slip clutch 50 by the high pressure in the nip will allow the jack shaft 34 to be pushed down into the screw jack 26 and instantaneous relief of the pressure, but will then immediately drive the back up roll 8 back into operating position without the customary recoil impact resulting from prior spring or fluid, air, biasing systems.

Any kind of mechanical jack can be used in the inventive biasing system, but it is preferred to use one of lower mechanical advantage, i. e. preferably less than about 10:1 to minimize the pressure that can build up in the nip between the backup roll 8 and the blades 7 due to a thicker feed before it is relieved and to reduce the reaction time to relieve the pressure. A preferred screw jack is a Duff-Norton 2-ton Machine Screw Actuator #TM-9002-4, 6:1 ratio with a 4 inch stroke available from the Duff-Norton Co. of Charlotte, N.C.

The preferred slip clutch is Polyclutch™ #SFS-44-8K-12K with the torque preset to 50 lb. inches available from Custom Products Company of North Haven, Conn., but other types of slipping systems can be used instead of the slip clutch 50. For example, a magnetic constant torque clutch that uses an adjustable field on granular ferrites to set and maintain the desired torque limit can be used. Other slipping mechanisms that will achieve the disclosed function of this component of the inventive system can also be used.

Figure 6:
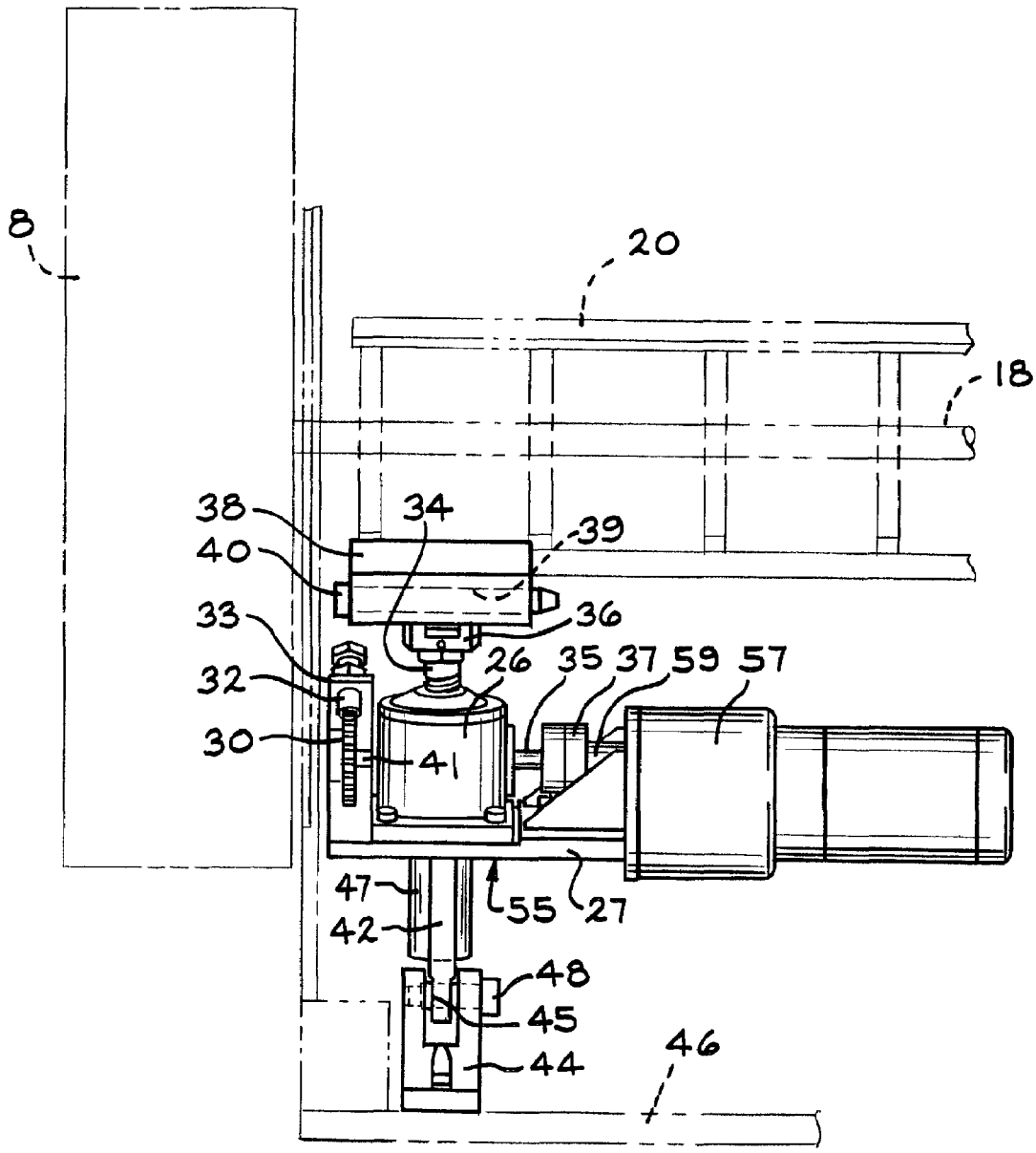
FIG. 6 is a partial side view of a more preferred embodiment of the invention shown in FIG. 2.
Figure 7:
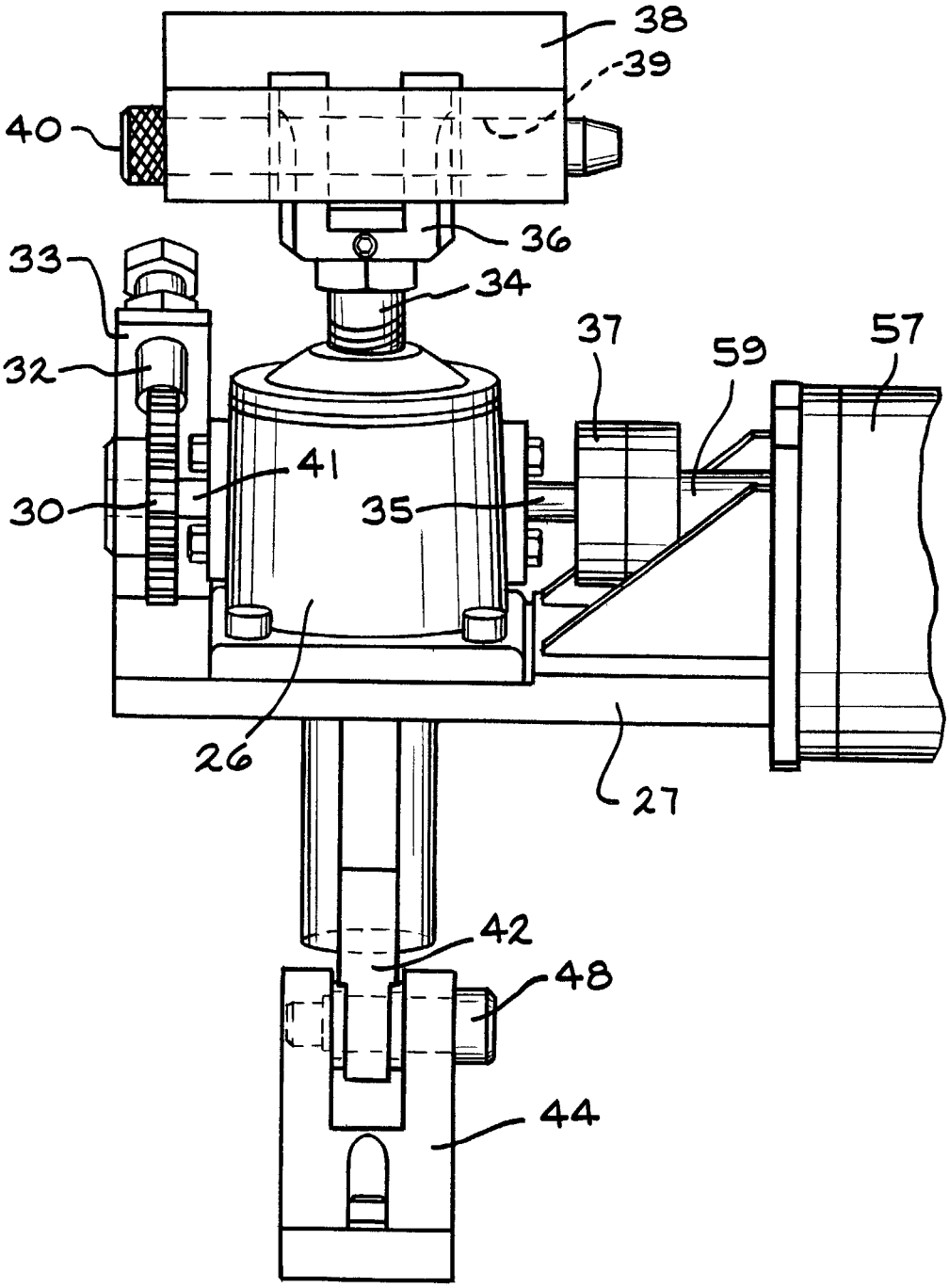
FIG. 7 is a blown up side view of the novel biasing system of the present invention shown in FIG. 6.

FIGS. 6 and 7 show a more preferred embodiment of a biasing assembly 55 that is identical with the other preferred embodiment described above, but using a different means for limiting the torque on the input shaft 35 of the jack 26. In FIGS. 6 and 7 the common elements of the biasing assembly are given the same numbers as in FIGS. 4 and 5. This biasing assembly 55 differs from the biasing assembly 24 described above in that it does not use the slip clutch 50. Instead a carefully sized stepping motor 57 having an output shaft 59 is connected directly to the input shaft 35 of the jack 26 using the conventional coupling 37. The stepping motor 57 is carefully sized to have a maximum output torque equal to or very near the maximum desired torque on the input shaft 35 of the jack 26 that will drive the blades 7 on the blade roll 6 the desired distance into the backup roll 8. When this distance is reached, the stepping motor 57 stalls and this can be seen by the operator by noting that the gear sensor/counter 32 is indicating that the toothed gear 30 is no longer rotating.

To set up the chopper of the present invention having the just described preferred biasing system, after new or reconditioned backup roll and/or a new or reconditioned blade roll have been installed, the stepping motor is jogged, or stepped, by the operator until jogging will no longer turn the element of the mechanical jack. This can be determined with the toothed gear and tooth sensor/counter described above or by watching said element during jogging. At this time the chopper is ready to run. After the chopper has been put into operation chopping, the stepping motor is occasionally jogged, either automatically with a timer or manually by the operator, until the element no longer rotates with the jogging. This controlled bias between the blades and the backup roll results in substantially longer life of the backup roll and improved quality of chopped items.

In another preferred embodiment of FIGS. 6 and 7, a higher torque stepping motor 57 can be used along with a conventional programmable control (not shown) for the stepping motor. The control is programmed to advance the stepping motor 57 different amounts and to reverse the stepping motor 57 to a common base. The different amounts of advance are exactly the amounts to bring the blades 7 of the blade roll 6 into the same depth of the working layer on backup rolls 8 having different diameters. A new backup roll 8 has the greatest diameter and this would be one diameter programmed in to the controller. Each time a backup roll 8 is removed from a chopper and dressed to produce a new smooth surface on the working layer, the diameter is decreased by a fixed amount. The controller is also programmed for a diameter after one dressing, after two dressings, and so on. After an operator installs a new backup roll 8 onto the chopper, he measures the diameter of the backup roll 8 and keys in the diameter. When the chopper 8 is ready to be put into operation, the operator pushes the biasing start button and the stepping motor 57 advances the programmed number of steps needed to properly position the blades 7 of the blade roll 6 with respect to the working layer of the backup roll 8 automatically. Although not necessary, the slip clutch 50 can also be used with this embodiment as a safety measure for the times when the operator might key in the wrong diameter.

Other embodiments employing the concept and teachings of the present invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. A chopper for separating long lengths of unwound item(s) selected from the group consisting of fibers, fiber strands, string, yarn, wire, tape and ribbon into short pieces, the item(s) running speed of above about 3000 ft/min, comprising a frame, a rotatable backup roll outboard of one side of the frame, the backup roll having a peripheral working layer, a rotatable blade roll outboard of the side of the frame, the blade roll having a plurality of blades spaced apart around its periphery for contact with and penetration of said items and into the peripheral working layer and a biasing system for biasing the blades of the blade roll and the backup roll together, the improvement comprising:

the biasing system being an assembly for biasing the blade roll and the backup roll together with an adjustable, but substantially constant force, said force being such that the blades of the blade roll will penetrate the peripheral working layer of the backup roll only a desired distance while separating the items into short pieces, the biasing system comprising a screw lack that extends and retracts as an element of the screw jack is rotated first one direction and then the opposite direction, a motor for rotating the element and a slip clutch that can maintain a substantially constant torque to the element of the mechanical jack during setup and operation of the chopper even when a thicker portion of the items passes through a nip between the blade roll and the backup roil, said slip clutch being located between said element of the screw jack and the motor.

2. A chopper for separating long lengths of unwound item(s) selected from the group consisting of fibers, fiber strands, string, yam, wire, tape and ribbon into short pieces, the item(s) running speed of above about 3000 ft./min, comprising a frame, a rotatable backup roll outboard of one side of the frame, the backup roll having a peripheral working layer, a rotatable blade roll outboard of the side of the frame, the blade roll having a plurality of blades spaced apart around its periphery for contact with and penetration of said items and into the peripheral working layer and a biasing system for biasing the blades of the blade roll and the backup roll together, the improvement comprising;

the biasing system being an assembly for biasing the blade roll and the backup roll together with an adjustable, but substantially constant force even when a thicker portion of the items passes through a nip between the blade roll and the backup roll, the assembly comprising a screw jack that extends and retracts as an element of the screw jack is rotated in one direction and then in the opposite direction respectively, a stepping motor for rotating connected to a slip clutch having an adjustable torque limit connected to said element for maintaining a substantially constant torque on the element of the screw jack during operation of the chopper.

* * * * *